US005400438A

United States Patent [19]

Staff et al.

[11] Patent Number: 5,400,438

[45] Date of Patent: Mar. 28, 1995

[54] GARMENT WITH CONVERTIBLE COLLAR

[75] Inventors: Christopher Staff, Calabasas; Schaefer Adolph, Agoura Hills, both of Calif.

[73] Assignee: Authentic Fitness Products, Inc., Van Nuys, Calif.

[21] Appl. No.: 202,299

[22] Filed: Feb. 25, 1994

[51] Int. Cl.[6] ..... A41B 3/00

[52] U.S. Cl. ..... 2/129; 2/98; 2/108

[58] Field of Search ..... 2/129, 98, 108, 85, 2/87, 97, 94, 102, 135, 141.1, 141.2, 93

[56] References Cited

U.S. PATENT DOCUMENTS 1,172,317 2/1916 Solomon .
1,299,244 4/1919 Sherwin .
2,300,125 10/1942 Lapick .
2,920,328 1/1960 Hammersley .
3,137,008 6/1964 Abalman .
3,147,490 9/1964 Allen et al. .
5,115,516 5/1992 Golde .

*Primary Examiner*—Clifford D. Crowder
*Assistant Examiner*—Gloria Hale
*Attorney, Agent, or Firm*—Amster, Rothstein & Ebenstein

[57] ABSTRACT

A garment with a convertible collar includes a garment, a collar secured to the garment and defining a pouch with an open-top end, and a fleece-like sheet secured to the garment. The sheet is movable between a storage orientation, wherein substantially all of the sheet extends through the open-top end of the pouch and lies flat within the pouch, and a use orientation, wherein the sheet is substantially disposed outside of the pouch and overlies substantially all of the upper surface of the collar. Fasteners on the collar and the sheet releasably maintain the sheet in the use orientation, and fasteners on the pouch and the sheet releasably maintain the open-top end substantially closed when the sheet is in the storage orientation.

9 Claims, 3 Drawing Sheets

GARMENT WITH CONVERTIBLE COLLAR

BACKGROUND OF THE INVENTION

The present invention relates to a garment having a collar and more particularly to such a garment which can provide a fleece-like collar surface adjacent the wearer's face under cold but dry-weather conditions and a water-resistant collar surface under wet: weather conditions.

The purchasing public appears to be highly attracted to garments (such as jackets or coats) offering a collar having a fleece-like or furry upper surface which contacts the wearer's face when the collar is turned up to break the wind in cold weather. Garments with collars made of many other materials—for example, nylon jackets with nylon collars—may be equally effective in breaking the wind and protecting against cold weather, but they do not provide the subjective feeling of warmth that a furry or fleece-like surface provides.

On the other hand, when the weather becomes wet (e.g., rainy or snowy), the: exposed fleece-like collar surface typically absorbs a great amount of moisture and thereafter requires a prolonged period to dry. By way of contrast, collars made of the other materials—and especially nylon collars—may be water-resistant and quick drying even after saturation with water.

Thus, ideally a collar would provide a fleece-like surface for use in cold, dry weather, and a water-resistant surface for use in wet weather.

Accordingly, it is an object of the present invention to provide in one embodiment a garment with a convertible collar.

Another object is to provide such a garment capable of affording against the wearer's face a fleece-like surface during cold, dry weather, and a water-resistant surface during wet weather.

Another object is to provide such a garment wherein in one embodiment the water-resistant surface protects the fleece-like surface from becoming wet.

A further object is to provide such a garment wherein in one embodiment the fleece-like surface lies flat and parallel to the water-resistant surface so that the collar does not appear thick or bulky.

It is another object of the present invention to provide in one embodiment such a garment wherein the fleece-like sheet and the collar are permanently secured to the garment to preclude separation and loss.

SUMMARY OF THE INVENTION

It has now been found that the above and related objects of the present invention are obtained in a garment with a convertible collar comprising a garment, a collar secured to the garment and defining a pouch with an open-top end, and a sheet (preferably a fleece-like sheet) secured to the garment. The sheet is movable between a storage orientation, wherein substantially all of the sheet extends through the open-top end of the pouch and lies flat within the pouch, and a use orientation, wherein the sheet is substantially disposed outside of the pouch and overlies substantially all of the collar. First securing means on the collar and the sheet releasably maintain the sheet in the use orientation; and second securing means on the pouch and the sheet releasably maintain the open-top end substantially closed when the sheet is in the storage orientation.

In a preferred embodiment, the garment additionally includes means permanently securing the collar to the garment adjacent the open-top end of the pouch. The first securing means comprises mating pieces of VELCRO at the free ends of the collar and the sheet, respectively, and the second securing means comprises mating pieces of VELCRO at the ends of the pouch and the sheet, respectively, secured to the garment. The collar is water-retardant, and the sheet is relatively water-absorbent and preferably fleece.

In a variant of the preferred embodiment, the garment with a convertible collar comprises a garment, a collar secured to the garment and defining a pouch with an open end, and a sheet secured to the garment. The sheet is movable between a storage orientation, wherein substantially all of the sheet lies flat within the pouch, and a use orientation, wherein the sheet is substantially disposed outside of the pouch and at least partially overlies the collar. First securing means releasably maintain the sheet in the use orientation; and second securing means releasably maintain the open end substantially closed when the sheet is in the storage orientation.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with accompanying drawing wherein.

DETAILED DESCRIPTION OF THE PREFERRED EMBODIMENTS

Figure 1:
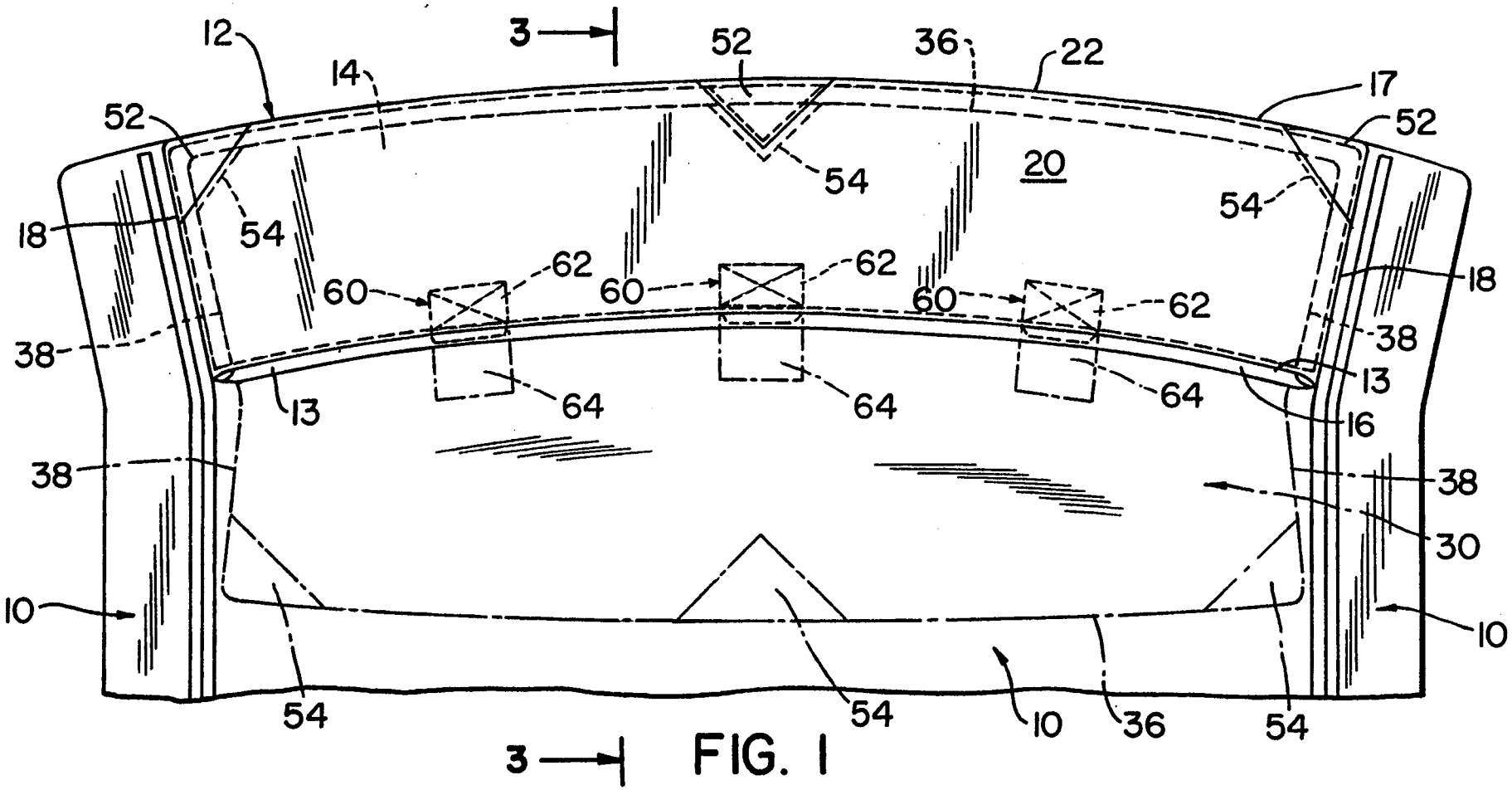
FIG. 1 is a fragmentary top plan view of a garment with a convertible collar according to the present invention, the fleece-like sheet being illustrated in a storage orientation in dashed line and in an intermediate orientation (between storage and use) in phantom line.

Referring now to the drawing, and in particular to FIG. 1 thereof, therein illustrated is a garment according to the present invention, generally designated by the reference numeral 10. The garment 10 includes a convertible collar, generally designated 12, which preferably provides against the wearer's face when the collar is turned up a fleece-like first surface suitable for dry but cold weather or a water-resistant second surface suitable for wet weather to protect the fleece-like surface from become water-logged. Of course, different types of first and second surfaces may be employed depending upon the specific requirements and personal taste. For example, the first surface could be formed of fur and the second surface of wool. Alternatively, GORE-TEX fabric could be used for the second surface, for example. Indeed, the two surfaces may differ only in color.

Still referring to FIG. 1, the collar 12 has an upper surface 20 and a lower surface 22, the lower surface 22 being secured to the garment 10 by stitching 13 or like, preferably permanent, securing means. The collar is preferable formed of nylon or a like water-resistant or waterproof material.

The generally flat collar 12 defines a generally flat pouch 14 having an open-top end 16 secured to the garment 10, a closed free end 17 (which hangs down the garment's back), and a pair of sides 18 connecting the ends 16, 17. It will be appreciated that, at least at first blush, the collar 12 does not reveal its pouch-like nature. It has only the thickness of a typical thick collar, and the open-top end 16 is at least partially concealed by the garment 10.

A sheet 30 has one end 32 permanently secured to the garment 10 (for example, by stitching 13), a free end 36, and a pair of sides 38 connecting the ends 32, 36. The sheet 30 is movable between a storage orientation illustrated in FIGS. 1 and 3, wherein substantially all of the sheet extends through the open-top end 16 of the pouch 14 and lies flat within the pouch 14, and a use orientation illustrated in FIGS. 2 and 4, wherein the sheet is substantially disposed outside of the pouch 14 and overlies substantially all of the upper surface 20 of the collar 20. The sheet 30 is preferably fleece-like on at least one surface and may be made, for example, of any of the well known furs (whether natural or artificial) or like fleece-like materials. Typically the sheet 30 is water-absorbent relative to the water-retardant collar 12.

The interior dimensions of the pouch 14 defined by collar 12 are selected to enable the sheet 30 to lie flat therein so that the collar 12 is relatively thin.

Figure 2:
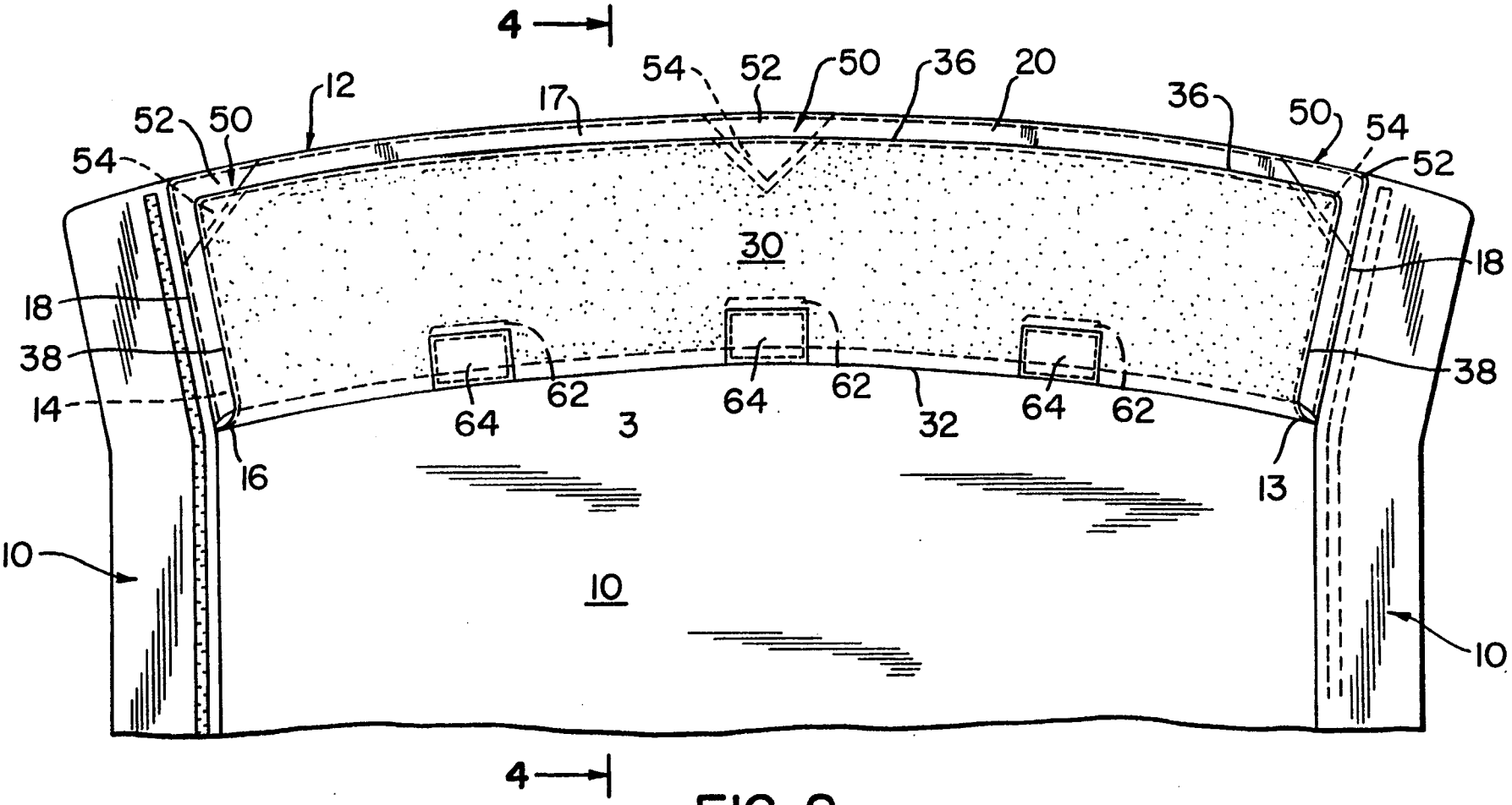
FIG. 2 is a view similar to FIG. 1, but with the fleece-like sheet in a use orientation.
Figure 4:
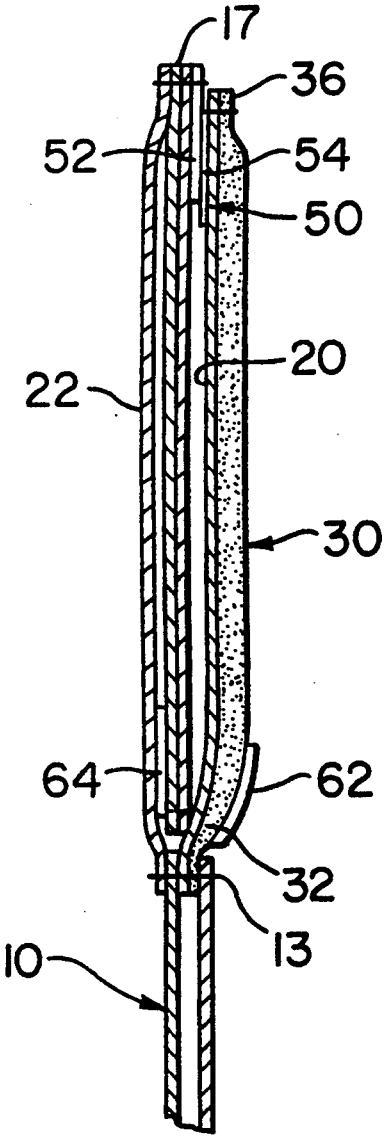

Referring now to FIGS. 2 and 4, first securing means generally designated 50, disposed on the collar 14 and on the sheet 30, releasably maintain the sheet 30 in its use orientation on the upper surface 20 of the collar 12. The first securing means 50 preferably comprises mating pieces 52, 54 of VELCRO, or another brand of a hook-and-loop fastener at the free ends of the collar 14 and the sheet 30, respectively. As illustrated, three triangular pieces of Velcro are used on each end.

Figure 3:
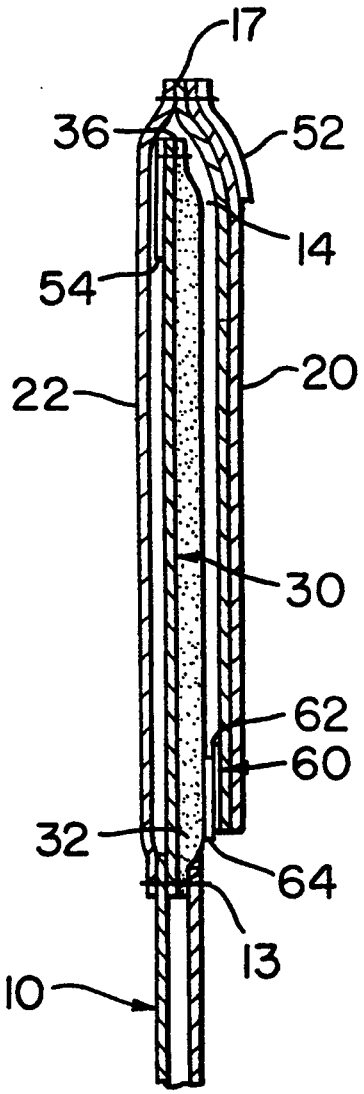
FIGS. 3 and 4 are sectional views taken along the lines 3—3 of FIG. 1 and 4—4 of FIG. 2, respectively.

Referring now to FIGS. 1 and 3, second securing means generally designated 60, disposed on the pouch 14 and on the sheet 30, releasably maintain the open-top end 16 of the pouch 14 substantially closed when the sheet 30 is in the storage orientation. The second securing means 60 preferably comprises mating pieces 62, 64 of VELCRO, hook and fasteners at the ends of the pouch 14 and the sheet 30, respectively, which are secured to the garment 10. As illustrated, three rectangular pieces of VELCRO, hook and fastener are used at each secured end of the pouch 14 and sheet 30.

It will be appreciated that the open-top end 16 is described as being only "substantially closed" when the sheet 30 is in the storage orientation because in fact the two ends —that is, the end or lip of the upper surface 20 adjacent the garment 10 and the end or lip of the lower surface 22 adjacent the garment—are not in direct contact. The lip of the upper surface 20 is secured to or closed on the upper surface of the stored sheet 30 rather than the lip of the lower surface 22. However, as the sheet end 32 is closely secured to the lip of the lower surface 22 by the stitching 13, this is sufficient to "substantially" close the open-top end 16.

Clearly, fewer Velcro, hook and loop fastener pieces may be used on smaller collars and sheets, and more Velcro, hook and loop fastener pieces may be used on larger collars and sheets. The mating pieces of Velcro, hook and loop fastener are, on the one hand, a great multitude of miniloops and, on the other hand, a great multitude of minihooks, with the miniloops and minihooks releasably interengaging when placed in contact. While hook and loop fasteners are preferred for the ease of use, obviously any of a wide variety of conventional fasteners may be employed for the same purpose, including hook-and-eye engagements, snap fasteners, zippers and the like. While the disposition of the mating pieces of Velcro, hook and fasteners have been illustrated as being at the ends of the pouch and sheet, clearly the mating pieces of Velcro, hook and loop fastener may be employed in other areas as well—for example, along the sides 18, 38.

To use the garment in warm weather (when the additional comfort of the fleece-like sheet 30 is not required) or during wet weather (when it is desirable to protect the sheet 30 from rain), the collar 12 is used with the sheet 30 in the storage orientation illustrated in FIGS. 1 and 3. The water-resistant material of the collar 12 prevents the sheet 30 from becoming wet, the open-top end pouch 16 being substantially closed. However, when the weather turns cold and dry, the lip of pouch upper surface 20 may be pulled away from the upper surface of the sheet end 32 so as to release the second securing means 60 and separate its elements 62, 64. This in turn enables the sheet free end 36 to be withdrawn from the pouch 14 through the now open open-top end 16 thereof, and flattened out, as illustrated in phantom line in FIG. 1. Then the sheet 30 is turned up and laid over the collar upper surface 20. In the resultant use orientation illustrated in FIGS. 2 and 4, the elements 52, 54 of the first securing means 50 are overlapping and may be engaged to maintain the sheet 30 in the use orientation.

Upon a return to warm or wet weather, the procedure is simply reversed with the free ends of the sheet 30 and collar 12 being separated (by separation of elements 52, 54 of the first securing means 50) and the sheet 30 being inserted through the open-top end 16 and laid flat between the upper and lower surfaces 20, 22. At this point, the elements 62, 64 of the second securing means 60 are overlapping and may be engaged to substantially close the open-top end 16.

As best seen in FIGS. 3 and 4, the same stitching 13 is preferably used to secure both the collar 12 and the sheet 30 to the garment 10. While this enables an economical manufacturing procedure, if desired different stitching may be employed to connect the garment 10 to each of the two elements 12, 30. Similarly, while the garment 10 and collar 12 have been illustrated as formed of a two-ply material, each may be formed of fewer or more plys, as desired. Finally, it will be appreciated that the sheet 30 and collar upper surface 20 may be substantially co-extensive in the use orientation, the off-setting of the sheet end 36 and sides 38 from the collar free end 17 and sides 18 in FIG. 2 being primarily for expository purposes.

The principles of the present invention have been illustrated in connection with an open-top type of collar, wherein the fleece-like sheet exits the open-top of the pouch adjacent the wearer's neck and then drapes downwardly over the upper surface of the collar towards the free end thereof. In an obvious variation thereof, a closed-top collar has an open-bottom end and the fleece-like sheet exits downwardly through the open-bottom of the pouch and then drapes upwardly over the upper surface of the collar towards the wearer's neck. In this variation, the sheet may be attached directly to the free end of the upper or lower surface of the collar and thereby to the garment.

To summarize, the present invention provides a garment with a convertible collar capable of affording against the wearer's face a fleece-like surface during cold, dry weather, and a water-resistant surface during wet weather, the water-resistant surface protecting the fleece-like surface from becoming wet. The fleece-like surface lies flat and parallel to the water-resistant surface so that the collar does not appear thick or bulky. The collar and sheet are permanently secured to the garment to preclude separation and loss.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A garment with a convertible collar comprising:
(A) a garment;
(B) a collar secured to said garment and defining a pouch with an open-top end;
(C) a sheet secured to said garment and movable between a storage orientation, wherein substantially all of said sheet extends through said open-top end of said pouch and lies flat within said pouch, and a use orientation, wherein said sheet is substantially disposed outside of said pouch and overlies substantially all of said collar;
(D) first securing means on said collar and said sheet for releasably maintaining said sheet in said use orientation; and
(E) second securing means on said pouch and said sheet for releasably maintaining said open-top end substantially closed when said sheet is in said storage orientation.

2. The garment of claim 1 additionally including means permanently securing said collar to said garment adjacent said open-top end of said pouch.

3. The garment of claim 1 wherein said sheet is fleece-like.

4. The garment of claim 1 wherein said collar has a pair of opposed ends, one of said collar ends being a free end, said sheet has a pair of opposed ends, one of said sheet ends being a free end, and said first securing means comprises mating pieces of a hook-and-loop fastener at said free ends of said collar and said sheet, respectively.

5. The garment of claim 1 wherein said sheet has an end, and said second securing means comprises mating pieces of a hook-and-loop fastener at said open-top end of said pouch and said end of said sheet, respectively, secured to said garment.

6. The garment of claim 1 wherein said collar is water-retardant, and said sheet is relatively water-absorbent.

7. A garment with a convertible collar comprising:
(A) a garment;
(B) a water-retardant collar secured to said garment and defining a pouch with an open-top end being permanently secured to said garment adjacent said open-top end of said pouch;
(C) a relatively water-absorbent fleece-like sheet of material secured to said garment and movable between a storage orientation, wherein substantially all of said sheet extends through said open-top end of said pouch and lies flat within said pouch, and a use orientation, wherein said sheet is substantially disposed outside of said pouch and overlies substantially all of an upper surface of said collar;
(D) first securing means on said collar and said sheet for releasably maintaining said sheet in said use orientation, said first securing means comprises mating pieces of a hook-and-loop fastener at the free ends of said pouch and said sheet, respectively.
(E) second securing means on said pouch and said sheet for releasably maintaining said open-top end substantially closed when said sheet is in said storage orientation, said second securing means comprises mating pieces of a hook-and-loop fastener at the ends of said pouch and said sheet, respectively, secured to said garment.

8. A garment with a convertible collar comprising:
(A) a garment;
(B) a collar secured to said garment and defining a pouch with art open end;
(C) a sheet secured to said garment and movable between a storage orientation, wherein substantially all of said sheet lies flat within said pouch, and a use orientation, wherein said sheet is substantially disposed outside of said pouch and at least partially overlies said collar;
(D) first securing means for releasably maintaining said sheet in said use orientation; and
(E) second securing means for releasably maintaining said open end substantially closed when said sheet is in said storage orientation.

9. The garment of claim 8 wherein said collar is water-retardant, and said sheet is relatively water-absorbent.

* * * * *